US006347492B1

(12) United States Patent
Richardson

(10) Patent No.: US 6,347,492 B1
(45) Date of Patent: Feb. 19, 2002

(54) INSTALLATION OF WINDOWS

(75) Inventor: Christopher Richardson, Clitheroe (GB)

(73) Assignee: Ultraframe (UK) Limited, Lancashire (GB)

( * ) Notice: Subject to any disclaimer, the term of this patent is extended or adjusted under 35 U.S.C. 154(b) by 0 days.

(21) Appl. No.: 09/203,090

(22) Filed: Dec. 1, 1998

(30) Foreign Application Priority Data

Nov. 26, 1998 (GB) ..... 9825811

(51) Int. Cl.[7] ..... E06B 1/04
(52) U.S. Cl. ..... 52/213; 52/217
(58) Field of Search ..... 52/204.1, 204.5, 52/211, 213, 217, 204.55, 204.56, 204.57, 656.1, 656.2, 656.5

(56) References Cited

U.S. PATENT DOCUMENTS 5,566,524 A * 10/1996 Bettin ..... 52/717.01
5,596,851 A * 1/1997 Ting ..... 52/211
5,619,828 A * 4/1997 Ver Meer ..... 52/213
5,901,528 A * 5/1999 Richardson ..... 52/783.1
6,003,277 A * 12/1999 Graham ..... 52/309.7

FOREIGN PATENT DOCUMENTS

| | | |
|---|---|---|
| DE | 1974591 A1 | 4/1975 |
| DE | 2354861 | 5/1975 |
| GB | 2287273 A | 9/1995 |
| GB | 2295185 A | 5/1996 |

* cited by examiner

*Primary Examiner*—Beth A. Stephan
(74) *Attorney, Agent, or Firm*—Rockey, Milnamow & Katz, Ltd.

(57) ABSTRACT

A combined window shelf and sill component is formed by extrusion of plastics material and has a top wall and a bottom wall connected by webs to form ducts therethrough and providing a window shelf end, a sill end and an intermediate portion for siting a window frame thereon.

4 Claims, 1 Drawing Sheet

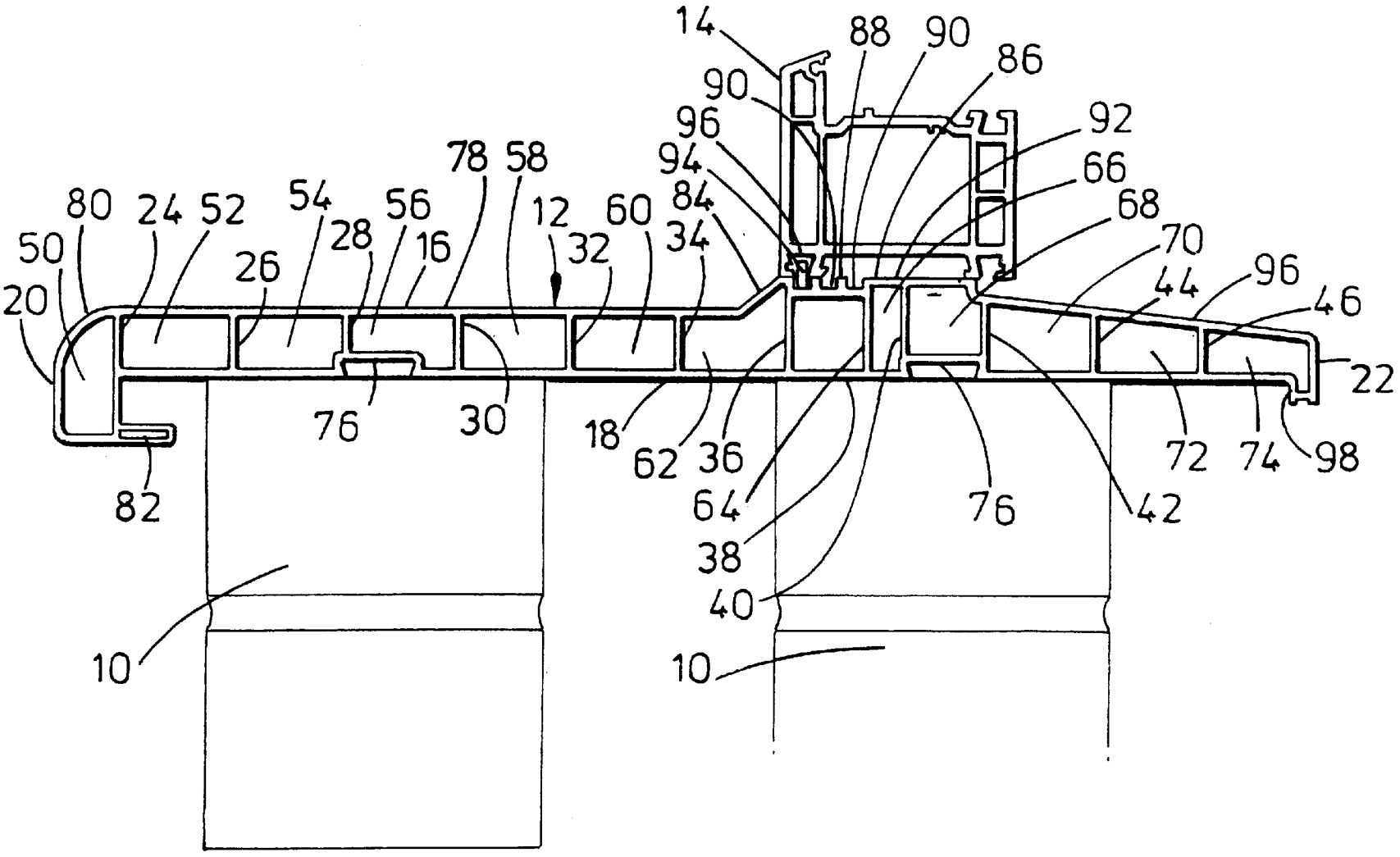
22
46
98
96
74
72
44
70
42
68
66
92
86
76
90
88
14
90
96
94
84
34
36
64
38
40
10
62
18
60
32
12
58
30
78
16
56
28
76
54
26
52
24
82
80
50
20
10

INSTALLATION OF WINDOWS

TECHNICAL FIELD OF THE INVENTION

Background of the Invention

This invention cocerns improvements in and relating to installation of windows.

Generally a window frame is mounted on top of a window sill, so that part of the sill extends outwardly from the window frame. At the rear of the frame i.e. inside a building, a shelf is butted up again the sill and/or the frame. Often when installing replacement u-PVC window frames, for example, the original window shelf is left in position and only a u-PVC window sill is fitted. The junction of the shelf with the sill and/or the frame needs to be masked for the sake of appearance. Even if the window shelf is also replaced, the problem of making a neat junction between the shelf and the frame still exists possibly because of irregularities in the window opening.

One proposal for dealing with this problem was made in GB 2287273A, which describes a window frame system comprising a window shelf abutting a window sill member, a window frame mounted on a part of the window sill member and a beading strip for masking the junction of the window shelf with the window fame and/or sill, wherein the beading strip comprises a cover piece and a channel section depending from the cover piece located on an upstand of the window frame system, whereby the beading strip is locatable in position after assembly of the window frame shelf and sill.

Even this arrangement is not entirely satisfactory because of the possible unevenness of a window opening causing the beading not to seal properly along its entire length. Furthermore, there is no possibility of adjusting the lateral position of the frame relative to the window sill.

An object of this invention is to provide a solution to the above-mentioned problems of window installation.

According to this invention it is proposed that a combined window shelf and sill be provided i.e. as a one-piece construction. Preferably the combined window shelf and sill is formed by extrusion of plastics material, especially u-PVC.

The preferred combined window shelf and sill of the invention has a top wall and a bottom wall connected by webs to form ducts therethrough. At its window shelf end the combined component is preferably shaped to provide a rounded top edge profile and preferably has a return on its underside.

At its window sill end, the combined component preferably has a downwardly sloping top wall leading to an overhang extending below the bottom wall of the component whereby water falling on the sill can drop off the overhang rather than travel back along the underside of the component and into the supporting brickwork.

Between the shelf and sill parts, the combined component has a part on which a window frame can be mounted. That part preferably has means for lateral adjustment in the positioning of the frame relative to the shelf/sill. By lateral adjustment is meant adjustment normal to the plane of the window. Preferably the combined component has a series of locations for a locating element that also locates in a part of the window frame. The window frame can have a channel or slot on its underside and the combined component can have a sense of parallel slots in its top sure, whereby a peg, strip or the like can locate in the frame and one of the slots of the combined component according to the desired position of the window frame relative to shelf/sill component.

BRIEF DESCRIPTION OF THE DRAWING

This invention will now be further described, by way of example only, with reference to the accompanying drawing, which is a section through a window shelf and sill arrangement according to the invention.

DETAILED DESCRIPTION OF THE INVENTION

Referring to the accompanying drawings, a double layer brick wall 10 has a combined window sill and shelf 12 mounted thereon and a window frame 14 mounted on the window sill/shelf.

The window sill and shelf 12 is made as a hollow plastics extrusion, typically of u-PVC. The window sill and shelf 12 has a top wall 16, bottom wall 18 and end walls 20 and 22 enclosing a plurality of ducts 50, 52, 54, 56, 58, 60, 62, 64, 66, 68, 70 and 72 formed by webs 24, 26, 28, 30, 32, 34, 36, 38, 40, 42, 44, and 46 connecting the top and bottom walls. The bottom wall 18 is straight apart from two channels 76 in its underside. The top wall 16 has a first part 78 forming a window shelf for the interior of a building which is parallel to the bottom wall over most of its width. At one end the top wall first part 18 is curved at 80 to meet end wall 20 which extends below the bottom wall as does the web 24. The extension of the web 24 has on its outer face a dusted flange 82 returning parallel to the bottom wall. This provides a neat and pleasing appearance to the window shelf.

At its opposite end the top wall 16 first part 78 has an upwardly inclined portion 84 leading to a second part 86 of the sill/shelf on which the window frame 14 is mounted. That part 86 of the sill/shelf has a first section 88 that has a series of parallel slots 90 in its top surface and a second flat section 92. The tops of the ridges forming the slots 90 are level with the top of the flat section 92. The slots 90 receive in one or other of them a peg or strip 94. The peg or strip 94 also locates in a channel 96 in the underside of the window frame 14. By locating the peg or strip 94 in a different slot 90, adjustments can be made to the position of the window frame 14 relative to the window sill/shelf 12.

The top wall 16 has a third section 96 forming the window sill. The top wall 16 slopes downwardly over this section and curves downwardly, at a free edge of the window sill, to form the end or front wall 22. The front wall 22 continues below the level of the bottom wall and is bridged to a downwards flange 98 of the bottom wall to form an overhang. That is so water landing on the sill will travel down the top wall 16 and down the front wall 22 where water drops will form and fall of the sill rather than travel back under the sill, which is to avoid water penetration between the sill and the wall.

Thus, the invention provides a one-piece window sill and shelf that is easy to fit and provides for variations in position of a window frame as well as simplifying installation of u-PVC windows without tile need for adjustments to be made to accommodate an existing window shelf.

What is claimed is:

1. A combined window shelf and window sill component comprising a one-piece extrusion of plastics material, the component defining a window shelf, a window sill having a free edge, and an intermediate portion, which is adapted to mount a window frame in a selected one of plural, incrementally positioned, frame mounting locations at incrementally differing distances from the free edge of the window sill, wherein the intermediate portion has a top wall, at which the intermediate portion is so adapted, and wherein the top wall of the intermediate portion has parallel slots, each being adapted to receive the window frame at a respective one of those locations.

2. A combination comprising the component of claim 1 and a window frame, which is received in a selected one of those slots, in a selected one of those locations.

3. A component defining a window sill and comprising a one-piece extrusion of plastics material, the window sill having a free edge and an intermediate portion, the component being adapted to mount a window frame in a selected one of plural, incrementally positioned, frame-mounting locations at incrementally differing distances from the free edge of the window sill, wherein the intermediate portion has a top wall, at which the intermediate portion is so adapted, and wherein the top wall of the intermediate portion has parallel slots, each being adapted to receive the window frame at a respective one of those locations.

4. A combination comprising the component of claim 3 and a window frame, which is received in a selected one of those slots, in a selected one of those locations.

* * * * *